US009555527B2

(12) United States Patent
Chen et al.

(10) Patent No.: US 9,555,527 B2
(45) Date of Patent: Jan. 31, 2017

(54) METHOD FOR CONTROLLING TORQUE OUTPUT OF DC ELECTRIC TOOL

(71) Applicant: CHERVON (HK) LIMITED, Wanchai (HK)

(72) Inventors: Wu Chen, Nanjing (CN); Liang Chen, Nanjing (CN)

(73) Assignee: Chervon (HK) Limited, Wanchai (HK)

( * ) Notice: Subject to any disclaimer, the term of this patent is extended or adjusted under 35 U.S.C. 154(b) by 442 days.

(21) Appl. No.: 14/269,306

(22) Filed: May 5, 2014

(65) Prior Publication Data

US 2014/0332242 A1 Nov. 13, 2014

(30) Foreign Application Priority Data

May 13, 2013 (CN) ..... 2013 1 0176078

(51) Int. Cl.
*B25B 29/00* (2006.01)
*B25B 23/147* (2006.01)
*B25F 5/00* (2006.01)

(52) U.S. Cl.
CPC ..... *B25B 23/1475* (2013.01); *B25B 23/147* (2013.01); *B25F 5/00* (2013.01)

(58) Field of Classification Search
CPC ..... B25B 29/00; B25B 23/1457; B25F 5/00
USPC ..... 173/1, 2, 4, 176, 20
See application file for complete search history.

(56) References Cited

U.S. PATENT DOCUMENTS 6,655,471 B2 * 12/2003 Cripe ..... B25B 23/1405 173/1
2002/0175656 A1 * 11/2002 Matsunaga ..... H02J 7/0031 320/128

* cited by examiner

*Primary Examiner* — Nathaniel Chukwurah
(74) *Attorney, Agent, or Firm* — Greenberg Traurig, LLP

(57) ABSTRACT

A method for controlling a torque output of a DC electric tool, includes presetting torque levels and voltage ranges corresponding to the torque levels, detecting the current output voltage of a battery and determining the voltage range in which the current output voltage is located, determining whether or not the current voltage range matches the preset torque level or not, and if the current voltage range does not match the preset torque level providing a warning that the torque output cannot reach the preset torque level and calculating and displaying a maximum torque level corresponding to the actual torque output value and, if the current voltage range does match the preset torque level, calculating the current actual torque output value and keeping a PWM modulation value constant if the torque output value conforms to the preset torque level or increasing the PWM modulation value for compensation if the torque output value does not conform to the preset torque level.

9 Claims, 5 Drawing Sheets

METHOD FOR CONTROLLING TORQUE OUTPUT OF DC ELECTRIC TOOL

RELATED APPLICATION INFORMATION

This application claims the benefit of CN 201310176078.4, filed May 13, 2013, the disclosure of which is incorporated herein by reference in its entirety.

FIELD OF THE DISCLOSURE

The present disclosure generally relates to DC electric tools and, more particularly, to a method for controlling torque output of a DC electric tool.

BACKGROUND OF THE DISCLOSURE

Currently, various fastener impacting tools are powered by electricity, thus also referred to as DC electric tools. The current DC electric tools mostly have an adjustable function for the torque output. The current DC electric tools may have three torque ranges, i.e., high, middle and low torque ranges, which can be switched therebetween by an adjusting switch. In each range, the torque output can be adjusted between zero and the maximum value in this range by a trigger, for example via use of pulse width modulation or PWM, but the decreasing of the speed and the output torque due to the decreasing of the voltage of the battery in the DC electric tool is not taken into account, and the tool is simply set with a plurality of levels to speed. When the voltage of the battery is decreased, the decreasing of the voltage of the battery may cause the decreasing of the maximum speed or the torque output, but the users cannot detect it, which causes the users to not be able to select the suitable level for the current operating condition or the fastener cannot be fastened tightly, thereby affecting the normal and reliable operation of the DC electric tool.

SUMMARY

The object of the present disclosure is to overcome the shortcomings existing in the prior art. The present disclosure provides a method for controlling the torque output of a DC electric tool, which can automatically compensate for the output torque and provide a warning message when it is determined that the currently available supply of electricity will not allow the DC electric tool to reach the preset torque output, thereby ensuring the normal and reliable operation of the DC electric tool.

In order to achieve the above object, the technical solutions of the present disclosure are as follows:

A method for controlling torque output of a DC electric tool, comprising:

step (1), presetting a plurality of torque levels and a plurality of voltage ranges corresponding to the torque levels;

step (2), detecting the current output voltage of a battery and determining the voltage range in which the current output voltage is located;

step (3), determining whether the current voltage range matches the selected torque level or not, and entering the next step if the current voltage range matches the selected torque level, otherwise, warning that the torque output cannot reach the selected torque level, and further calculating and displaying the highest torque level which the current voltage is capable of providing; and step (4), calculating the current actual torque output value, and keeping a PWM value constant for maintaining the current actual torque output value if the current actual torque output value conforms to the selected torque level; or increasing the PWM value for compensation if the current actual torque output value does not conform to the selected torque level so that the current actual torque output value can reach the preset value corresponding to the selected torque level.

According to the foregoing method for controlling torque output of a DC electric tool, in step (1), the plurality of torque levels may include a first torque level, a second torque level, a third torque level and a fourth torque level.

According to the foregoing method for controlling torque output of a DC electric tool, n the step (1), the plurality of voltage ranges may include a first voltage range, a second voltage range, a third voltage range and a fourth voltage ranging from high to low.

According to the foregoing method for controlling torque output of a DC electric tool, when the current voltage of the battery is in the first voltage range, the output torque can be kept constant in any one of the first to the fourth torque levels, when the current voltage of the battery is in the second voltage range, the output torque can be kept constant in any one of the second to the third torque levels, and when the current voltage of the battery is in the third voltage range, the output torque can be kept constant in the third torque level.

According to the foregoing method for controlling torque output of a DC electric tool, in the step (2), detecting the current output voltage of the battery may be performed by driving a motor.

The voltage compensating method for controlling the torque output of the DC electric tool provided in the present disclosure can automatically compensate for the output torque by detecting the output voltage of the battery, and decrease or reduce the level output error of the tool having an adjustable torque level output, so that the torque output of the DC electric tool can be more accurate and switched in a certain constant level and the users can better use the tool. Moreover, the present method can also provide a warning message when determining that the current electricity will not allow the tool to reach the preset torque output, thereby ensuring the normal and reliable operation of the DC electric tool.

DETAILED DESCRIPTION

The present disclosure will be explained in detail with reference to the drawings.

Figure 1:
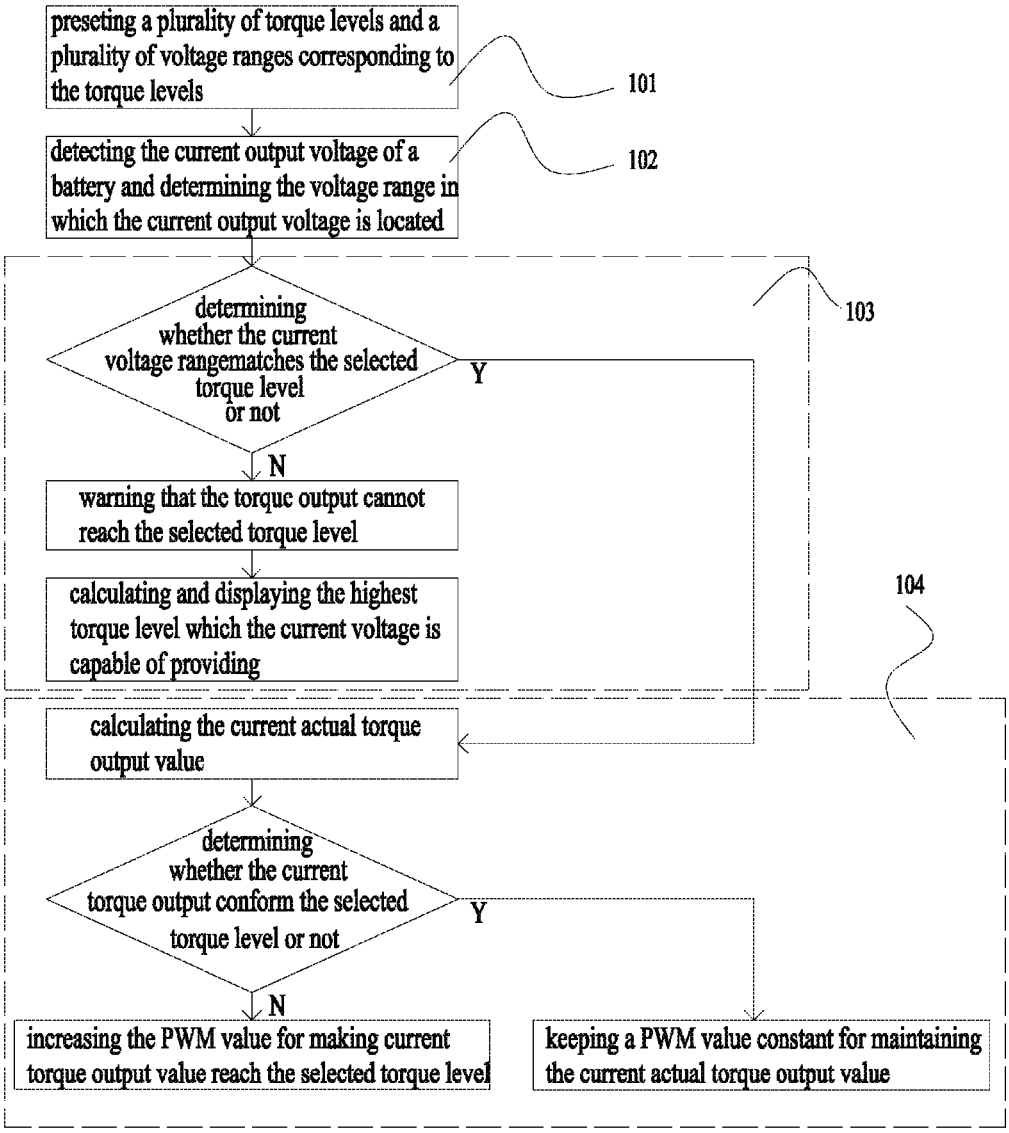
FIG. 1 is a basic controlling flowchart of an exemplary method for controlling the torque output of a DC electric tool according to the present disclosure.
Figure 2:
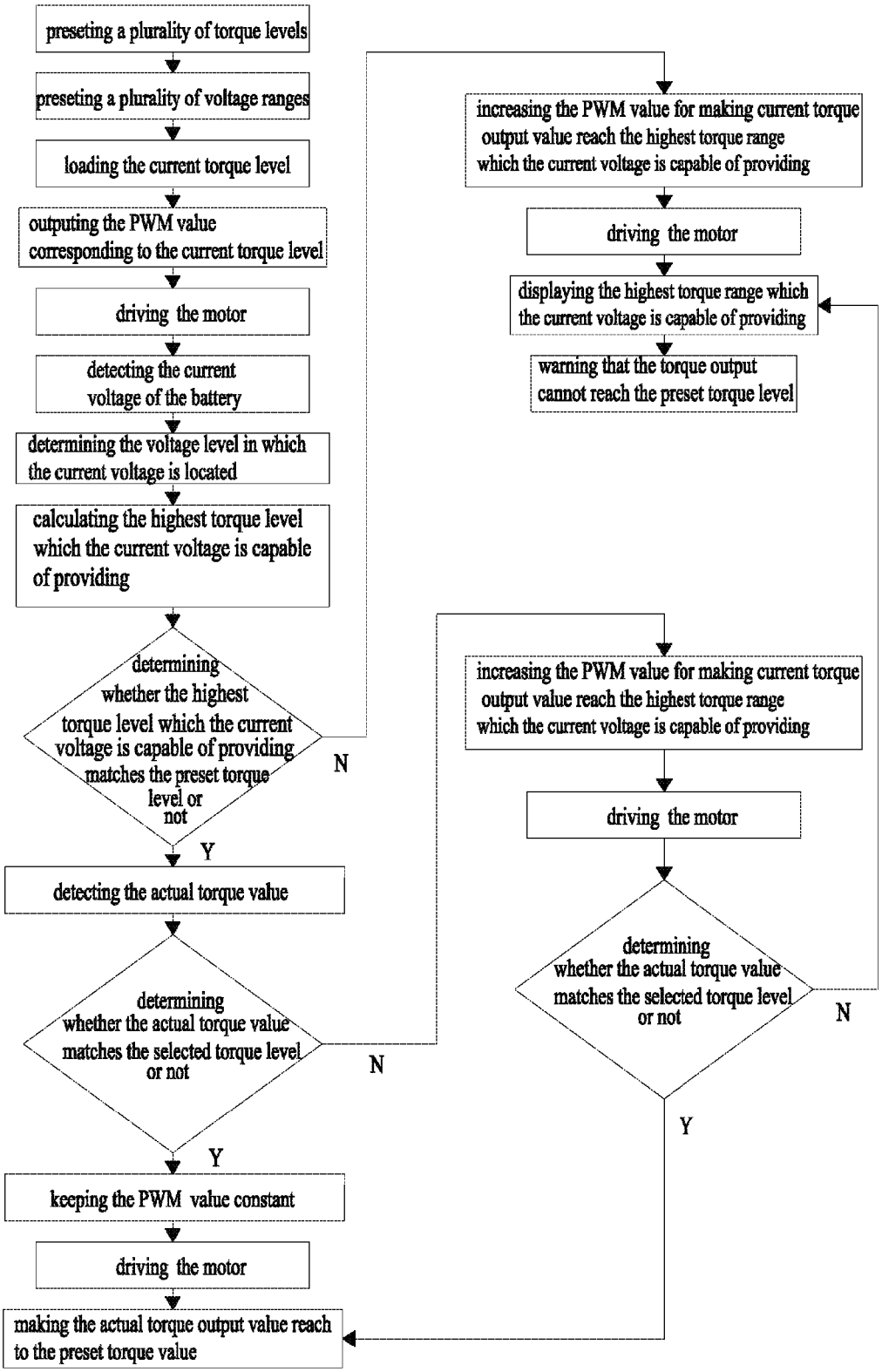
FIG. 2 is a process flowchart of an exemplary method for controlling the torque output of a DC electric tool according to one embodiment of the present disclosure.

The voltage compensating method for controlling the torque output of the DC electric tool of the present disclosure can automatically compensate for the output torque by detecting the output voltage of the battery, and decrease or reduce the level output error of the tool having an adjustable torque level output, so that the torque output of the DC electric tool can be more accurate and switched in a certain constant level and the users can better use the tool. Moreover, the present method can also provide a warning message when determining that the current electricity will not allow the tool to reach the preset torque output. Referring to FIGS. 1 and 2, the method will be illustrated as follows.

In Step 101, a plurality of torque levels and a plurality of voltage ranges corresponding to the torque levels are preset within the device. The plurality of torque levels includes a first torque level, a second torque level, a third torque level and a fourth torque level from small to large. The plurality of voltage ranges include a first voltage range, a second voltage range, a third voltage range and a fourth voltage range from high to low, and the fourth voltage range is the lowest voltage range.

In Step 102, the current output voltage of a battery of the DC electric tool is detected and the voltage range in which the current output voltage is located is determined.

In Step 103, it is determined whether the current voltage range matches the preset torque level or not, and step 104 is entered if the current voltage range matches the selected torque level, otherwise, a warning is provided that the torque output cannot reach the selected torque level, and the highest torque level which the current voltage is capable of providing is calculated and displayed.

In Step 104, the current actual torque output value is calculated, and a PWM value is kept constant for maintaining the current actual torque output value if the current actual torque output value conforms to the selected torque level; and the PWM value is increased for compensation if the current actual torque output value does not conform to the selected torque level so that the current actual torque output value can reach the preset value corresponding to the selected torque level.

In Step 102, the current output voltage of the battery is detected in real-time by driving a motor. In step 103, the warning that the torque output cannot reach the preset torque level is achieved by presenting a warning in a display screen or activating a warning indication light. In addition, if the requirement for the convenience is relatively low, it does not need to calculate and display the highest torque level which the current voltage is capable of providing, and the users can select the lower torque level until the current voltage can provide the output torque corresponding to the selected torque level.

Figure 3:
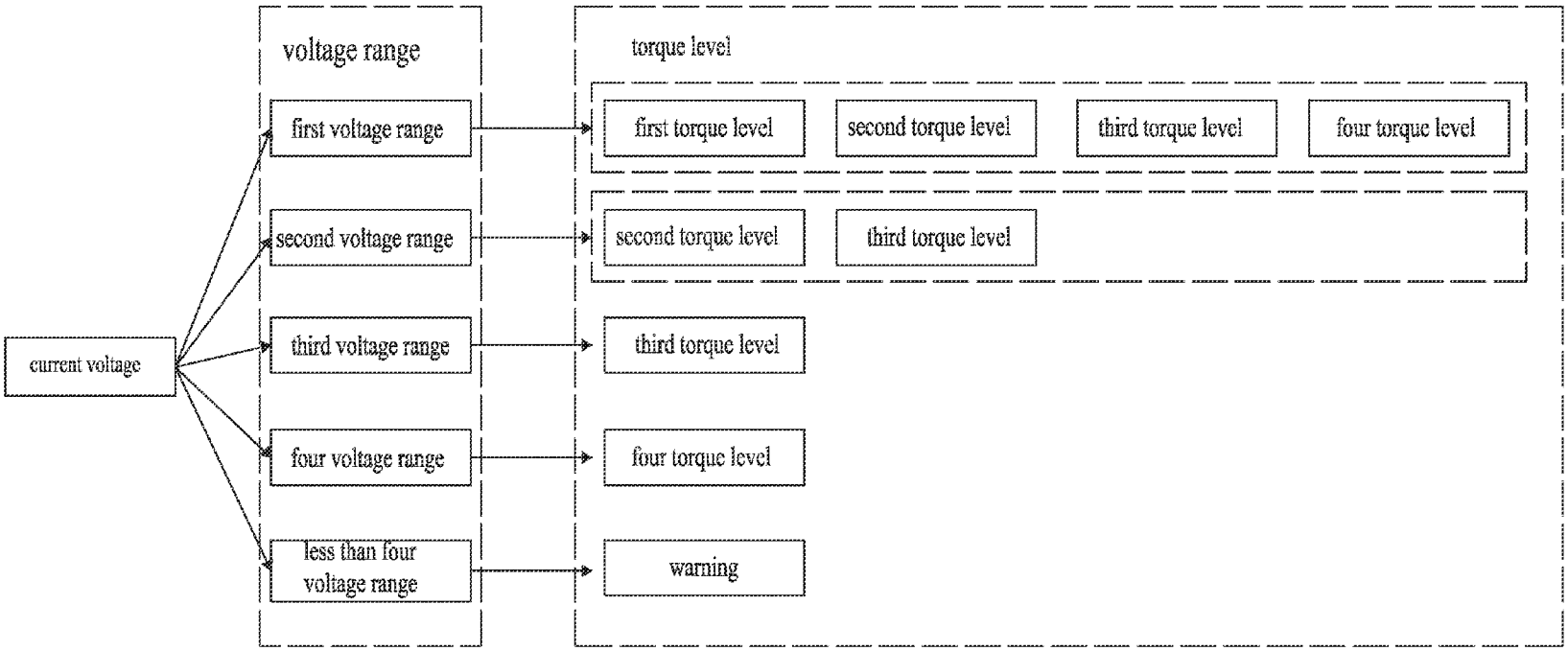
FIG. 3 is a block diagram showing a relationship between voltage ranges and torque levels according to one embodiment of the present disclosure.

If the current voltage of the battery is decreased gradually, as shown in FIG. 3, the output torque can be constant in the plurality of torque levels as mentioned in the step 101 with the compensation provided by increasing the PWM value. When the current voltage of the battery is in the first voltage range, the output torque can be constant in any one of the first to the fourth torque levels. When the current voltage of the battery is in the second voltage range, the output torque can be constant in any one of the second to the third torque levels. When the current voltage of the battery is in the third voltage range, the output torque can be constant in the third torque level.

The following description will explain one embodiment of the voltage compensation method for controlling the output torque of the DC electric tool according to the present disclosure, as shown in FIG. 2.

The torque output can be preset as a first torque level (preset torque value is 40 NM), a second torque level (preset torque value is 30 NM), a third torque level (preset torque value is 20 NM), a fourth torque level (preset torque value is 15 NM). It may be appreciated that these torque ranges can also be preset according to the actual requirements of the electric tool, and the value is not limited to the above ranges. The first level can be preset as the lowest level while the fourth level can be preset as the highest level.

The voltage of the battery of the DC electric tool can be divided into a plurality of voltage ranges from high to low. The voltages of the battery include a first voltage range, a second voltage range, a third voltage range and a fourth voltage range, wherein the fourth voltage range is the minimum voltage range. The above voltage ranges may be static or dynamic, for example, the voltage range may be A[X1, Y1] when the load is low and automatically adjusted to A[X2, Y2] when the load is high. As shown in table 1 below, the relationship between the value of the voltage range and the torque level is such that, when the selected torque level cannot match the voltage range, the torque output warning indicator can provide a warning message. In this case, the torque cannot be kept constant by increasing the PWM value. If the selected level can match the voltage range, the torque can be kept constant by increasing the PWM value when the battery voltage is decreased.

TABLE 1

The relationship between the value of the voltage range and the torque level

| voltage range/ torque level(preset torque value) | First torque level (40 NM) | Second torque level (30 NM) | Third torque level (20 NM) | Fourth torque level (15 NM) |
|---|---|---|---|---|
| First voltage range (e.g., 80%~100%) | OK | OK | OK | OK |
| Second voltage range (e.g., 60%~80%) | warning | OK | OK | OK |
| Third voltage range (e.g., 60%~40%) | warning | warning | OK | OK |
| Fourth voltage range (e.g., 40%~60%) | warning | warning | warning | OK |
| Fifth voltage range (e.g., 20%~40%) | warning | warning | warning | warning |

The current voltage of the battery of the DC electric tool and determining the voltage range in which the current output voltage is located is preferably detected in real-time.

Figure 4:
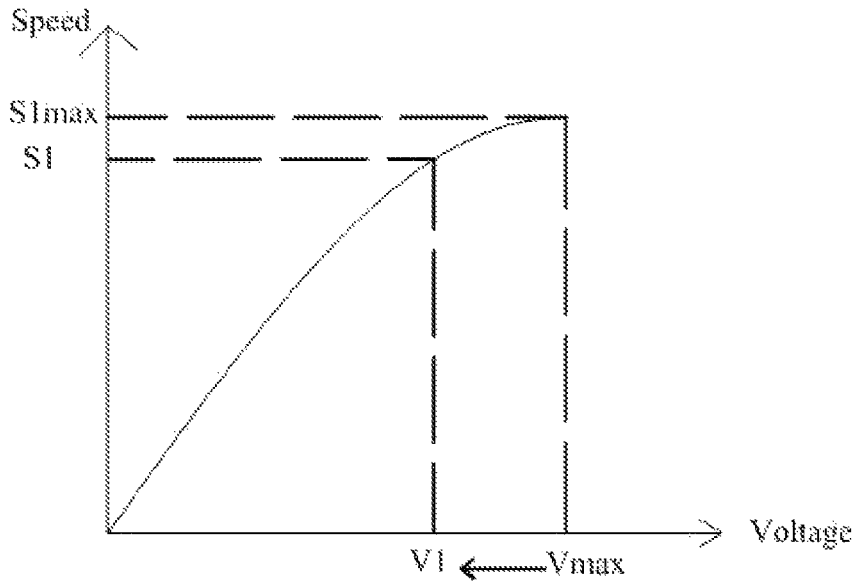
FIG. 4 is a schematic view showing the changing range of the voltage in the first voltage range according to one embodiment of the present disclosure.
Figure 5:
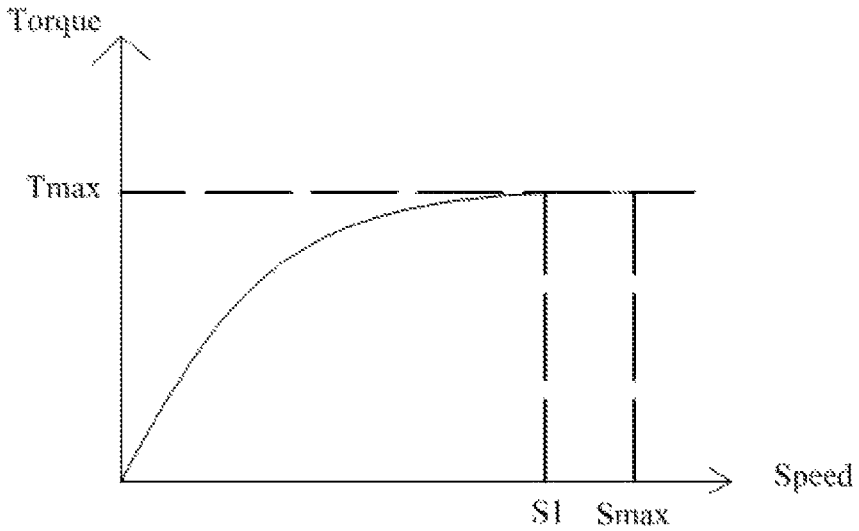
FIG. 5 is a schematic view showing the changing range of the output speed of the main shaft switched in the fourth torque level in the first voltage range according to one embodiment of the present disclosure.
Figure 6:
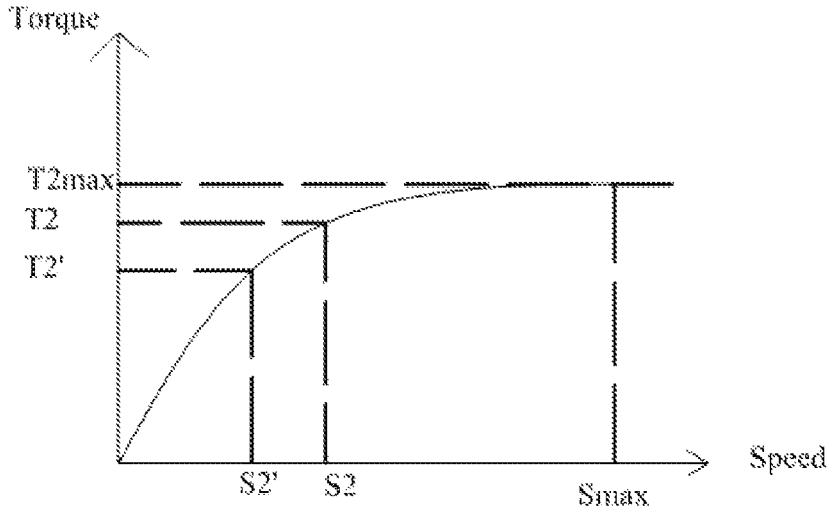
FIG. 6 is a schematic view showing the changing range of the output speed of the main shaft switched in the third torque level in the first voltage range according to one embodiment of the present disclosure.
Figure 7:
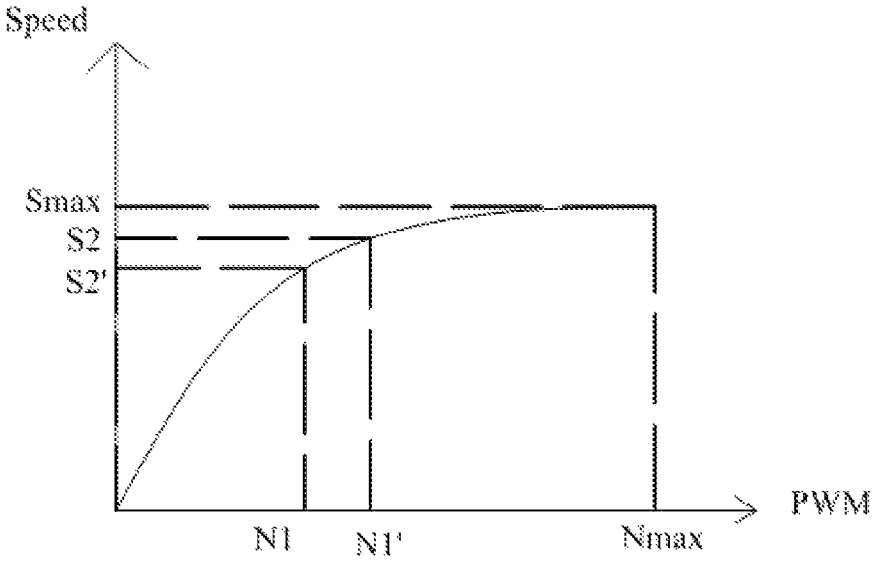
FIG. 7 is a schematic view showing the compensation changing range of the PWM value switched in the third torque level in the first voltage range according to one embodiment of the present disclosure.

If the current voltage of the battery is in the first voltage range, as shown in FIG. 4, the voltage of the battery can be decreased to V1 from $V_{MAX}$ in this voltage range. As shown in FIG. 5, the output speed of the main shaft in the first torque level (the maximum torque level) can be decreased to S1 from S1 max, but the torque output is not decreased, or the decreasing amount can be neglected. As shown in FIG. 6, if the output speed of the main shaft in the third torque level is decreased to S2' from S2 and the corresponding maximum output torque is decreased to T2' from T2, while the PWM value corresponding to the output speed S2 of the main shaft in the third torque level is N1, that is, the compensation is made by increasing the PWM value. As shown in FIG. 7, the PWM value is increased to N1' from N1. When N1' corresponds to the voltage V1, the output speed of the main shaft can be increased to S2, i.e., the output speed of the main shaft is adjusted by the PWM value, thereby obtaining the object of the constant output torque. In this way, the output torque can be constant in any one of the first to the fourth torque levels.

When the current voltage of the battery is in the second voltage range and the voltage of the battery is decreased in this range, the compensation can also be made by increasing the PWM value, but the first torque level in the second voltage range cannot reach the preset torque output. If the user adjusts the torque level to the first torque level in the operating process, the torque output indicator can warn that the current actual output torque is less than the preset output torque, or directly warn the actual output torque that is currently reachable, and then the output torque can be constant only in any one of the second to the fourth torque levels.

When the current voltage of the battery is in the third voltage range and the voltage of the battery is decreased in this range, the compensation can also be made by increasing the PWM value. Also, the output torque can be constant only in any one of the third torque level to the fourth torque level. A warning message can be provided if other torque levels are selected.

When the current voltage of the battery is in the fourth voltage range and the voltage of the battery is decreased in this range, the output torque can only be constant in the fourth torque level. A warning message can be provided if other torque levels are selected.

If the current voltage of the battery is in or below the voltage range, a warning message can be provided directly.

The present disclosure is capable of compensating for the torque output by increasing the PWM value in a certain threshold range, and decrease or reduce the level output error of the tool having an adjustable torque level output, so that the torque output of the DC electric tool can be more accurate and switched in a certain constant level and the users can better use the tool. Moreover, the present method can also provide a warning message when determining that the current electricity cannot reach the preset torque output, thereby ensuring the normal and reliable operation of the DC electric tool.

The basic principle, principal characters and advantages of the present disclosure have been illustrated and described above. It should be noted that the foregoing embodiments shall not limit the present disclosure in any form, and all the technical solutions as a result of equivalent substitutions or modifications shall fall into the scope of the present disclosure.

What is claimed is:

1. A method for controlling torque output of a DC electric tool, comprising:

presetting on the DC electric tool a plurality of torque levels and a plurality of voltage ranges corresponding to the plurality of torque levels;

detecting a current output voltage of a battery used to power the DC electric tool and determining one of the plurality of voltage ranges in which the current output voltage of the battery is located;

determining whether the one of the plurality of voltage ranges in which the current output voltage of the battery is located matches a selected one of the plurality of torque levels;

when it is determined that the one of the plurality of voltage ranges in which the current output voltage of the battery is located does not match a selected one of the plurality of torque levels providing a warning that a torque output of the DC electric tool cannot reach the selected one of the plurality of torque levels and further calculating and displaying a highest one of the plurality of torque levels which the current output voltage of the battery is capable of providing; and when it is determined that the one of the plurality of voltage ranges in which the current output voltage of the battery is located does match a selected one of the plurality of torque levels, calculating a current actual torque output value and keeping a PWM value constant for maintaining the current actual torque output value when the current actual torque output value conforms to the one of the plurality of selected torque levels or increasing the PWM value for compensation when the current actual torque output value does not conform to the selected one of the plurality of torque levels so that the current actual torque output value is capable of reaching the preset value corresponding to the selected one of the plurality torque levels.

2. The method for controlling torque output of a DC electric tool according to claim 1, wherein the plurality of voltage ranges comprise a first voltage range, a second voltage range, a third voltage range and a fourth voltage and wherein the plurality of voltage ranges range from high to low and wherein the fourth voltage range is the minimum voltage range.

3. The method for controlling torque output of a DC electric tool according to claim 2, wherein the plurality of torque levels comprise a first torque level, a second torque level, a third torque level and a fourth torque level.

4. The method for controlling torque output of a DC electric tool according to claim 3, wherein, when the current output voltage of the battery is in the first voltage range, the output torque is capable of being kept constant in any one of the first to the fourth torque levels, when the current output voltage of the battery is in the second voltage range, the output torque is capable of being kept constant in any one of the second to the third torque levels, and when the current output voltage of the battery is in the third voltage range, the output torque is capable of being kept constant in the third torque level.

5. The method for controlling torque output of a DC electric tool according to claim 1, wherein detecting the current output voltage of the battery is performed when a motor of the DC electric tool is driven.

6. A method for controlling torque output of a DC electric tool, comprising:

presetting on the DC electric tool a plurality of torque levels and a plurality of voltage ranges corresponding to the plurality of torque levels;

when a motor of the DC electric tool is driven, detecting a current output voltage of a battery used to power the DC electric tool and determining a one of the plurality of voltage ranges in which the current output voltage of the battery is located;

determining whether the one of the plurality of voltage ranges in which the current output voltage of the battery is located matches a selected one of the plurality of torque levels;

when it is determined that the one of the plurality of voltage ranges in which the current output voltage of the battery is located does not match a selected one of the plurality of torque levels providing a warning that a torque output of the DC electric tool cannot reach the selected one of the plurality of torque levels; and when it is determined that the one of the plurality of voltage ranges in which the current output voltage of the battery is located does match a selected one of the plurality of torque levels, calculating a current actual torque output value and keeping a PWM value constant for maintaining the current actual torque output value when the current actual torque output value conforms to the one of the plurality of selected torque levels or increasing the PWM value for compensation when the current actual torque output value does not conform to the selected one of the plurality of torque levels so that the current actual torque output value is capable of reaching the preset value corresponding to the selected one of the plurality torque levels.

7. The method for controlling torque output of a DC electric tool according to claim 6, wherein in the plurality of voltage ranges comprise a first voltage range, a second voltage range, a third voltage range and a fourth voltage range, wherein the voltage ranges range from high to low and wherein the fourth voltage range is the minimum voltage range.

8. The method for controlling torque output of a DC electric tool according to claim 7, wherein the plurality of torque levels comprise a first torque level, a second torque level, a third torque level and a fourth torque level.

9. The method for controlling torque output of a DC electric tool according to claim 8, wherein, when the current output voltage of the battery is in the first voltage range, the output torque is capable of being kept constant in any one of the first to the fourth torque levels, and when the current output voltage of the battery is in the second voltage range, the output torque is capable of being kept constant in any one of the second to the third torque levels, and when the current output voltage of the battery is in the third voltage range, the output torque is capable of being kept constant in the third torque level.

* * * * *